US009356385B2

(12) United States Patent
Kobayashi

(10) Patent No.: US 9,356,385 B2
(45) Date of Patent: May 31, 2016

(54) CONNECTOR WITH DRAINAGE GROOVES

(71) Applicant: Sumitomo Wiring Systems, Ltd., Yokkaichi (JP)

(72) Inventor: Kazumasa Kobayashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/519,191

(22) Filed: Oct. 21, 2014

(65) Prior Publication Data

US 2015/0126064 A1 May 7, 2015

(30) Foreign Application Priority Data

Nov. 7, 2013 (JP) ..... 2013-230905

(51) Int. Cl.
*H01R 13/52* (2006.01)
*H01R 12/72* (2011.01)

(52) U.S. Cl.
CPC ..... *H01R 13/5202* (2013.01); *H01R 12/724* (2013.01)

(58) Field of Classification Search
CPC ..... H01R 13/516; H01R 13/5202; H01R 13/5227; H01R 12/724; H02G 3/086; H02G 3/088
See application file for complete search history.

(56) References Cited

U.S. PATENT DOCUMENTS

| | | | | |
|---|---|---|---|---|
| 5,649,859 | A * | 7/1997 | Shiga | 454/275 |
| 7,357,650 | B2 * | 4/2008 | Sasaki et al. | 439/76.2 |
| 7,364,438 | B2 * | 4/2008 | Sasaki et al. | 439/76.1 |
| 7,514,629 | B2 * | 4/2009 | Sasaki et al. | 174/50 |
| 7,950,931 | B2 * | 5/2011 | Nakanishi et al. | 439/76.2 |

FOREIGN PATENT DOCUMENTS

| | | |
|---|---|---|
| JP | 2013-143286 | 7/2013 |

* cited by examiner

*Primary Examiner* — James Harvey
*Assistant Examiner* — Oscar C Jimenez
(74) *Attorney, Agent, or Firm* — Gerald E. Hespos; Michael J. Porco; Matthew T. Hespos

(57) ABSTRACT

A connector C is configured so that terminal fittings (10) extending from a rear surface of a housing (20) are connected to a board (50) and a casing (60) for covering the board (50) is mounted on the side of an upper surface (20U) of the housing (20), and drainage grooves (37) which extend in a width direction of the housing (20) and opposite ends of which reach opposite side surfaces (20S) of the housing (20) are provided on the upper surface of the housing (20).

8 Claims, 9 Drawing Sheets

CONNECTOR WITH DRAINAGE GROOVES

BACKGROUND

1. Field of the Invention

The invention relates to a connector.

2. Description of the Related Art

Japanese Unexamined Patent Publication No. 2013-143286 disclose a connector to be connected to a board is known. The connector has a housing and terminal fittings extending from the rear surface of the housing are connected to a board. The board is covered by a casing to prevent contact with foreign substances. The connector is fixed to an edge part of the board and the casing covers the entire upper surface side of the board and a part of the upper surface of the housing.

The above-described connector generally uses a drip-proof sheet to prevent entry of liquid, such as water, through a clearance between the casing and the housing. However, to further enhance waterproofness, there has been a demand for preventing the entry of liquid into the board side along the upper surface of the housing even if the liquid enters this clearance.

The invention was completed based on the above situation and aims to provide a connector capable of preventing the entry of liquid into a board side along an upper surface of a housing.

SUMMARY OF THE INVENTION

The invention relates to a connector with a housing and terminal fittings that extend from a rear surface of the housing for connection to a board. A casing is mounted on an upper surface side of the housing for covering the board. A drainage groove is provided on an upper surface of the housing and extends in a width direction so that opposite ends of the drainage groove reach opposite side surfaces of the housing. Thus, the liquid running along the upper surface of the housing enters the drainage groove and is drained to the side surface of the housing. As a result, liquid cannot enter into the board side along the upper surface.

A bottom surface of the drainage groove may be inclined down from a widthwise intermediate part of the housing toward the opposite side surfaces of the housing. Thus, the liquid that enters the drainage groove is introduced to the side surface of the housing by the inclination of the bottom surface. Therefore the liquid that enters the drainage groove can be drained smoothly to the side surface of the housing.

A width of the drainage groove may be smaller than a clearance formed on a side closer to the board out of clearances between the housing and the casing. Thus, the liquid more easily enters the drainage groove than the clearance formed on the side closer to the board by capillary phenomenon, and entry of the liquid into the board side along the upper surface of the housing can be prevented more reliably.

Plural drainage grooves may be provided while being spaced apart in a front-back direction. Accordingly, even if the liquid reaches the board side along one drainage groove, it enters another drainage groove to be drained. Thus, the entry of the liquid into the board side along the upper surface of the housing is prevented reliably.

According to the invention, it is possible to provide a connector capable of preventing the entry of liquid into a board side along an upper surface of a housing.

DETAILED DESCRIPTION

Figure 1:
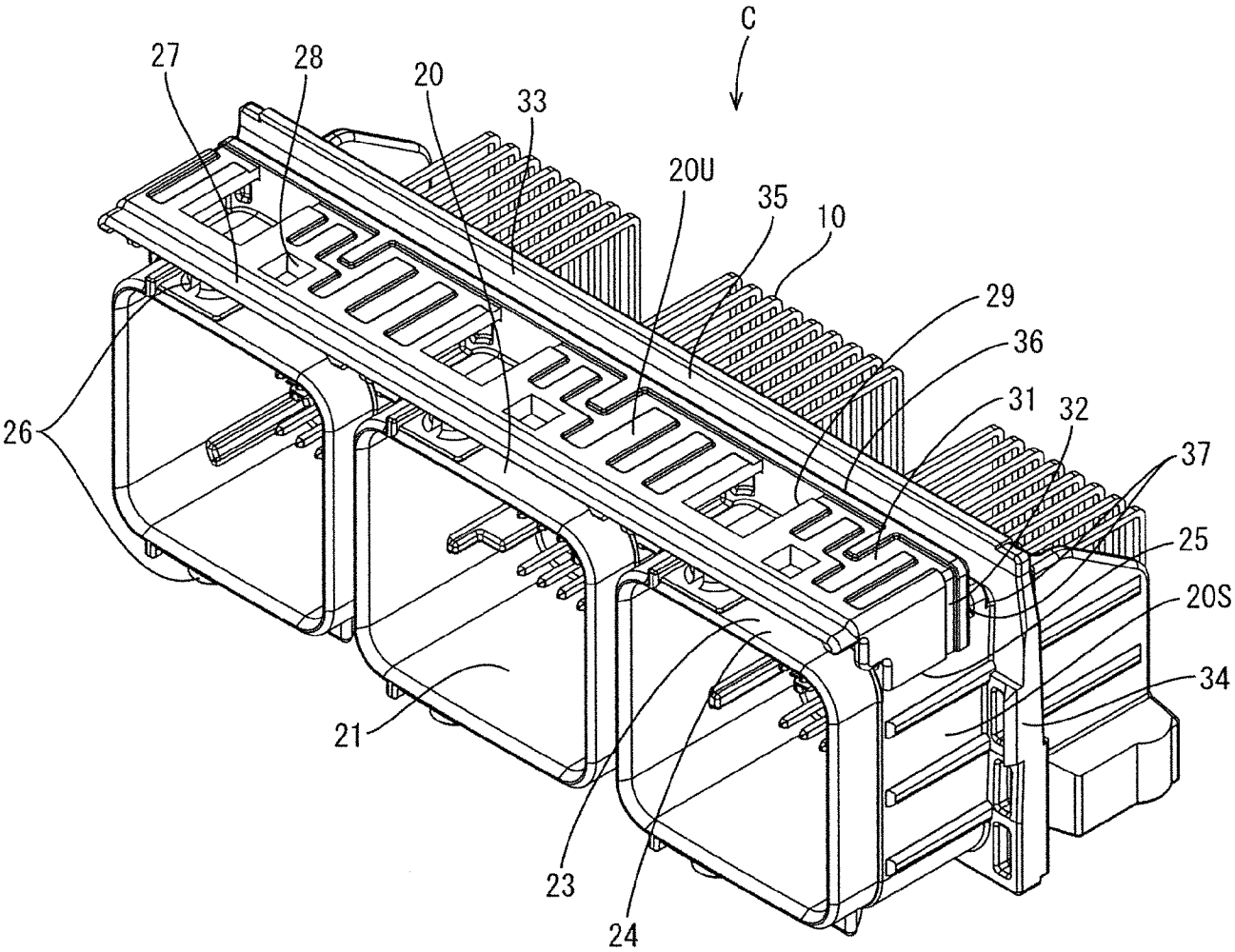
FIG. 1 is a perspective view of a connector according to an embodiment.

A lever-type airbag connector in accordance with the invention is identified by the letter C in FIGS. 1 to 9, and a connecting operation and a separating operation of which are assisted by rotating levers provided on unillustrated mating connectors. In each constituent member, an end to be connected to a mating end is referred to as a front end and an opposite end is referred to as a rear, and upper and lower sides of FIG. 1 are referred to as upper and lower sides.

Figure 7:
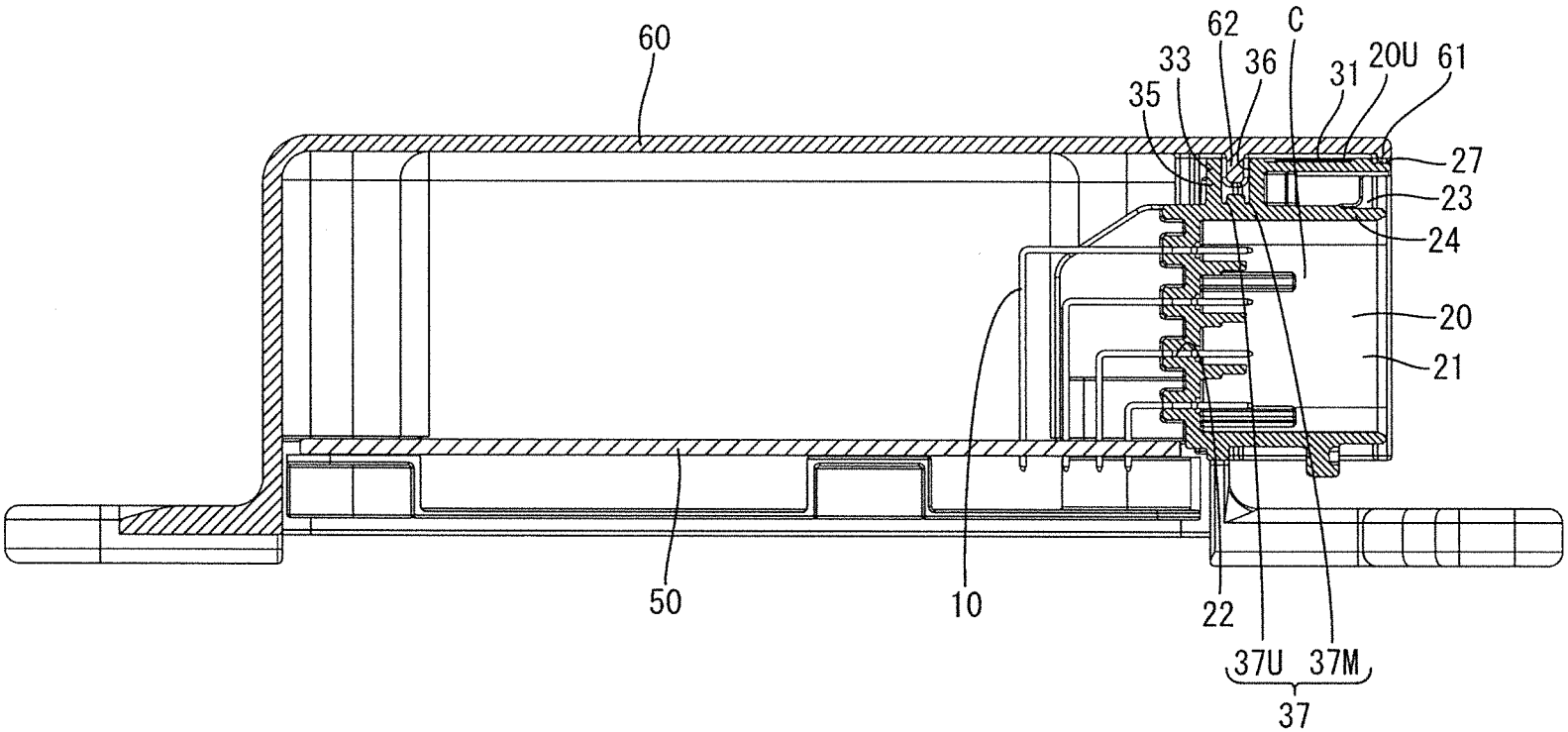
FIG. 7 is a section showing a state where the connector connected to a board is covered with a casing.

As shown in FIG. 1, the connector C includes male terminal fittings 10 and a housing 20 for holding the terminal fittings 10. As shown in FIG. 7, the connector C is a board connector in which the terminal fittings 10 extending from the rear surface of the housing 20 are connected to a board 50 and a casing 60 for covering the board 50 is mounted on the upper surface 20U of the housing 20.

The housing 20 is made of a synthetic resin and includes connector fittings 21. Each connector fitting 21 is open forward and a mating connector can fit tightly therein. The connector fittings 21 are provided side by side in a lateral direction and the housing 20 is wide in the lateral direction.

The terminal fittings 10 are formed by bending rectangular wire materials made of electrically conductive metal into an L shape and are held by being press-fit into terminal insertion holes 22 formed on the back wall of each connector fitting 21. A front end of the terminal fitting 10 projects forward from the back wall of the connector fitting 21 and is electrically connectable with a corresponding mating terminal fitting. A rear end of the terminal fitting 10 extends back from the rear surface of the housing 20, is bent down at a right angle, is inserted into an unillustrated through hole formed on the board 50 and is connected to an unillustrated conductive path, such as by soldering. Note that the connector C is connected to an outer edge part of the board 50 and the housing 20 is located at an outer side of the board 50 when the connector C is connected to the board 50.

Figure 2:
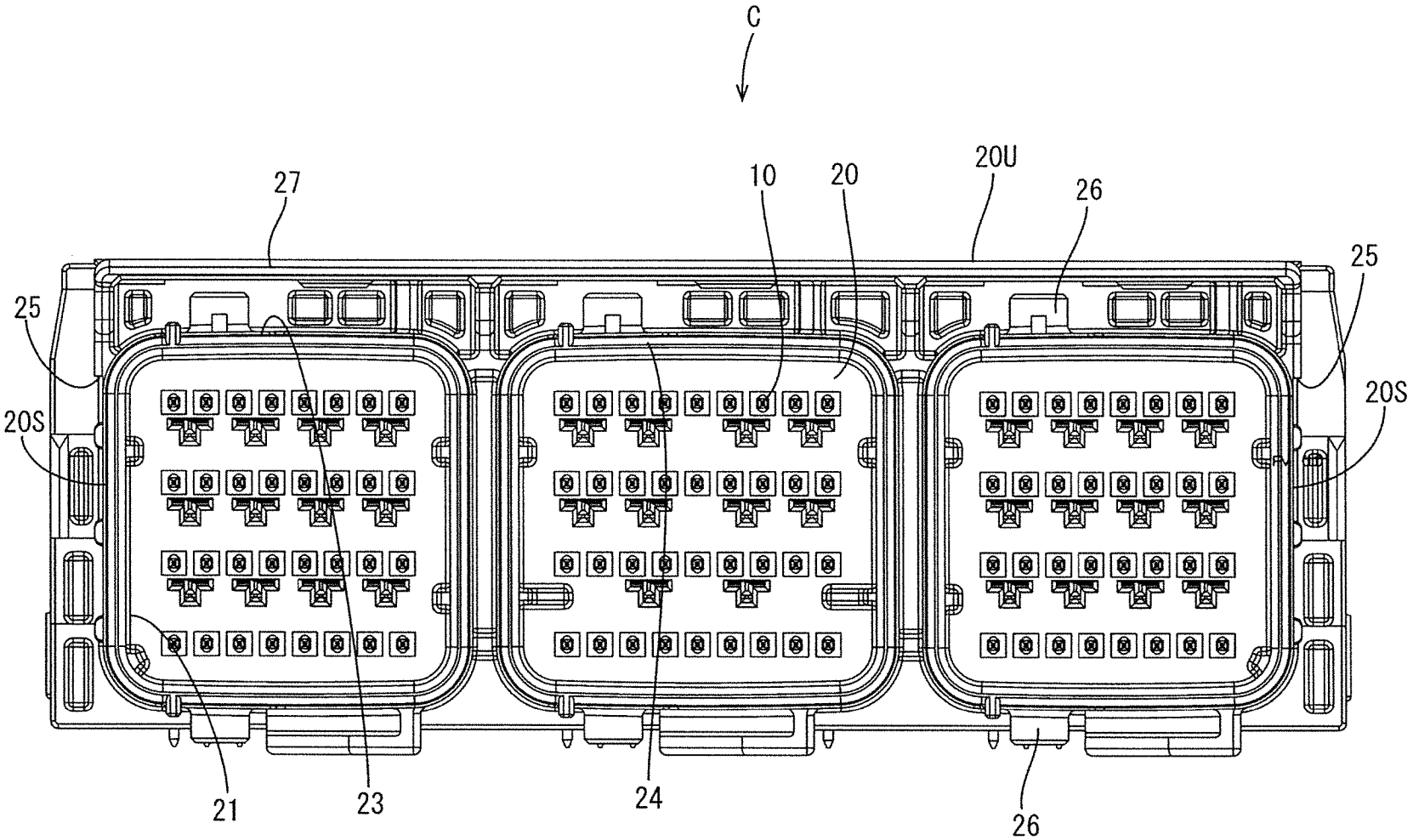
FIG. 2 is a front view of the connector.
Figure 3:
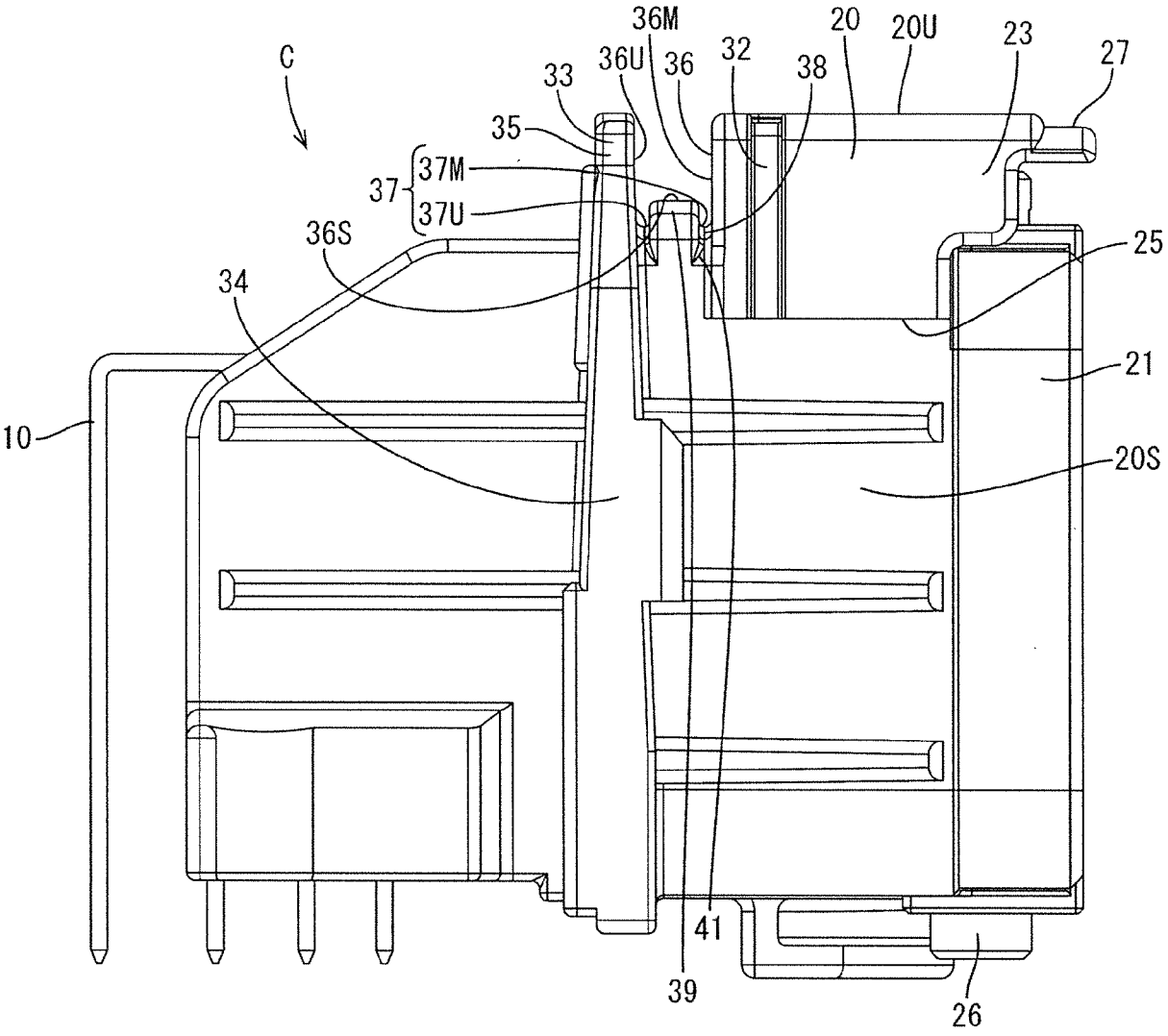
FIG. 3 is a side view of the connector.

The housing 20 includes forwardly open lever accommodating portions 23 in which the levers are accommodated at the time of connection to the mating connectors. As shown in FIG. 2, an accommodating portion 23 is provided for each connector fitting 21 and each lever accommodating portion 23 is provided above the respective connector fitting 21. The lever accommodating portions 23 and the connector fittings 21 are partitioned by a partition wall 24. Note that steps 25 are formed on side surfaces 20S of the housing 20 at boundaries between the side surfaces of the connector fittings 21 and those of the lever accommodating portions 23. Thus, side surfaces of the lever accommodating portions 23 are slightly outward from those of the connector fittings 21.

Cylindrical cam pins 26 are provided on the lower surface of each lever accommodating portion 23 and that of each connector fitting 21.

Figure 8:
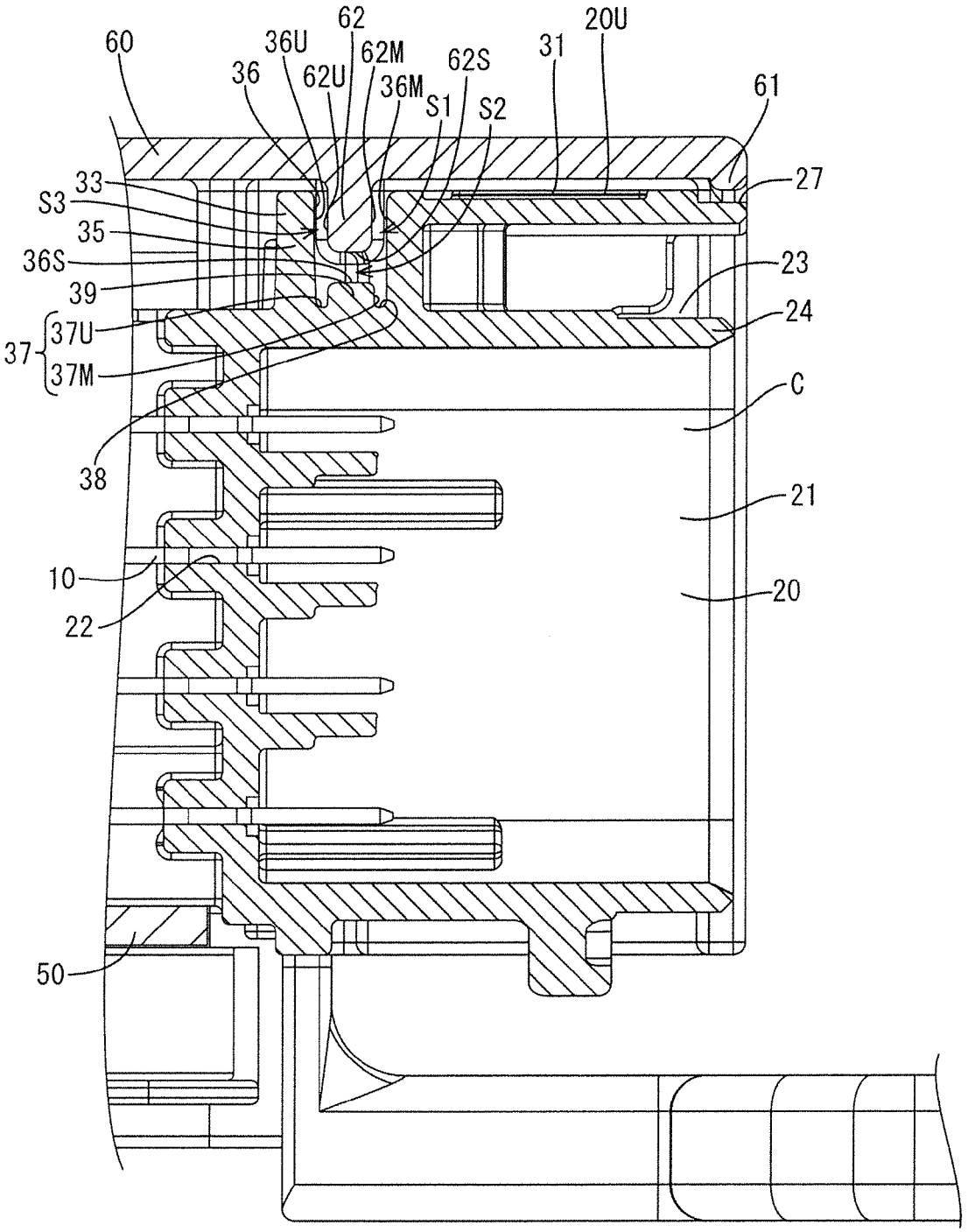
FIG. 8 is a partial enlarged section showing the state where the connector connected to the board is covered with the casing.

As shown in FIG. 8, a bulge 61 bulges down along the outer peripheral edge of the casing 60 and a recess 27 is provided on the upper surface 20U of the housing 20 at a position corresponding to the bulge 61. The recess 27 is formed over the entire width of the housing 20 along the front end edge of the upper surface 20U of the housing 20.

Lock holes 28 are provided on the upper surface 20U of the housing 20 (see FIG. 1) at positions corresponding to the respective lever accommodating portion 23 and lock projections on the levers are fit and locked therein. The lock hole 28 has a square shape and penetrates from the upper surface 20U of the housing 20 to the lever accommodating portion 23.

Mold removal openings 29 are formed on the upper surface 20U of the housing 20 for molding the rear surfaces of the cam pins 26. The openings 29 have a rectangular shape slightly longer in a front-back direction and penetrate from the upper surface 20U of the housing 20 to the lever accommodating portion 23. One opening 29 is provided for each of the cam pins 26.

Figure 4:
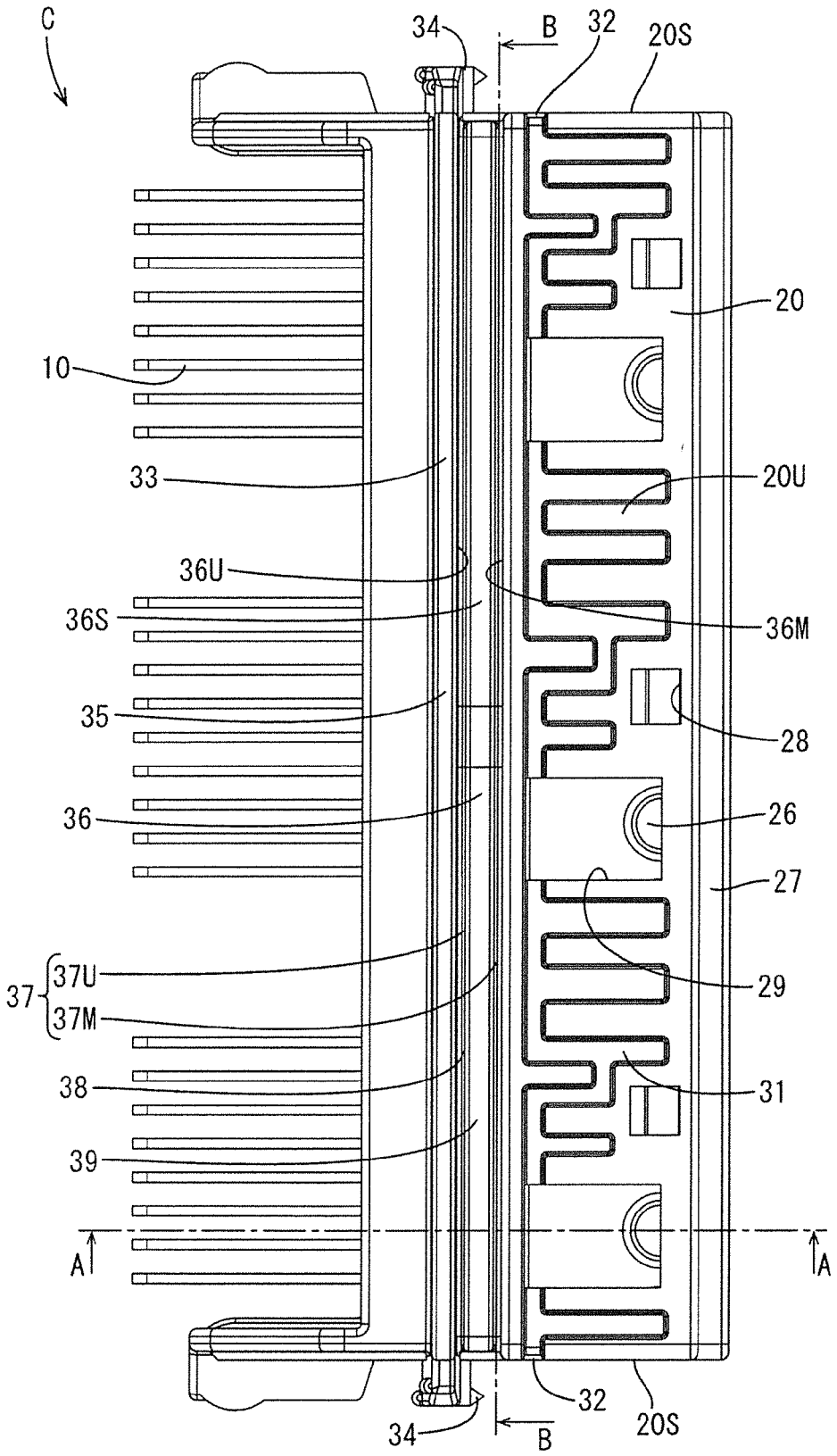
FIG. 4 is a plan view of the connector.

As shown in FIG. 4, liquid retaining portions 31 are provided on the upper surface 20U of the housing 20. Each liquid retaining portion 31 is formed by connecting at least one longitudinal groove extending in the front-back direction and at least one lateral groove extending in the lateral direction. The liquid retaining portions 31 are arranged at opposite sides of the openings 29 formed on the upper surface 20U of the housing 20. Each liquid retaining portion 31 reaches the side surface 20S of the housing 20 or the opening 29.

As shown in FIG. 1, drains 32 are provided on the opposite side surfaces 20S of the housing 20 for draining the liquid retained in the liquid retaining portions 31. Each drain 32 is continuous with a lateral groove of the liquid retaining portion 31. The drain 32 extends straight down from the upper surface 20U of the housing 20 and the lower end thereof reaches the step 25.

A standing wall 33 is provided at a position of the housing 20 near the rear end and projects on the opposite side surfaces 20S and the upper surface 20U of the housing 20. Parts of the standing wall 33 on the side surfaces 20S of the housing 20 define press-fit portions 34 to be press-fit into unillustrated grooves formed on the casing 60. Further, a part of the standing wall 33 on the upper surface 20U of the housing 20 defines a waterproof portion 35 for preventing entry of water behind this part. The waterproof portion 35 is provided over the entire width of the housing 20 and a height of the waterproof portion 35 is equal to a height of the lever accommodating portions 23.

A fitting recess 36 is formed between the waterproof portion 35 and the lever accommodating portions 23 as shown in FIG. 8 and can receive a rib 62 provided on the casing 60. The fitting recess 36 has a depth equal to the heights of the waterproof portion 35 and the lever accommodating portions 23 and is open on the opposite sides of the housing 20.

Clearances are formed between the casing 60 and the housing 20 when the casing 60 covers the connector C. The clearances include a clearance S1 in the front-back direction formed between a front surface 62M of the rib 62 of the casing 60 and a front surface 36M of the fitting recess 36 of the housing 20 and a clearance S3 in the front-back direction formed between a rear surface 62U of the rib 62 of the casing 60 and a rear surface 36U of the fitting recess 36 of the housing 20. The clearances S1 and S3 have substantially the same size. A vertical clearance S2 is defined between a lower surface 62S of the rib 62 of the casing 60 and a bottom surface 36S of the housing 20. The clearance S2 is larger than the clearances S1 and S3.

Figure 5:
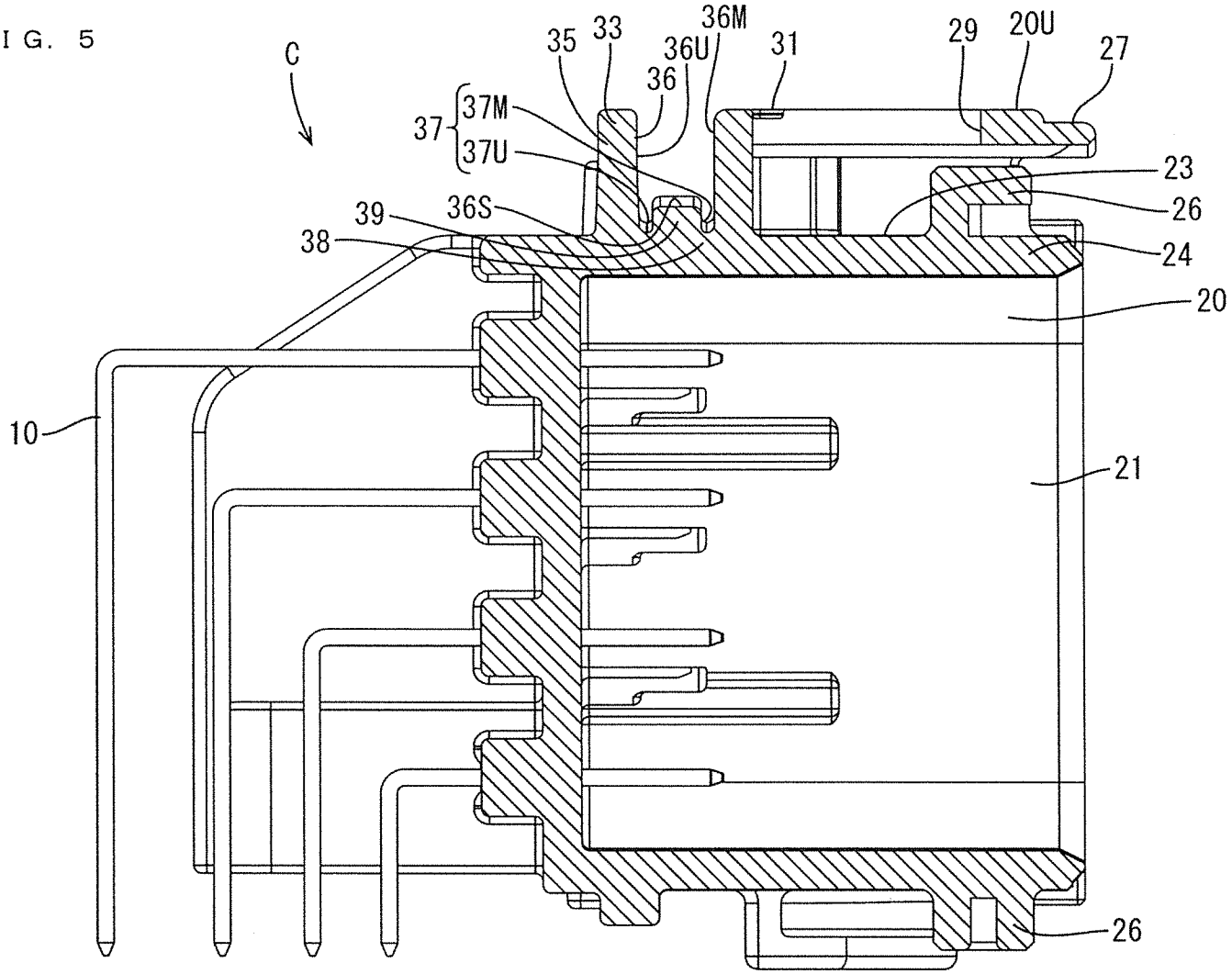
FIG. 5 is a section taken along line A-A of FIG. 4.

As shown in FIG. 4, drainage grooves 37 are provided on the upper surface 20U of the housing 20 and extend in a width direction of the housing 20 so that opposite ends of the drainage grooves reach the opposite side surfaces 20S of the housing 20. As shown in FIG. 5, the drainage grooves 37 include front and rear drainage grooves 37M and 37U formed on the bottom surface 36S of the fitting recess 36.

The front drainage groove 37M extends straight along the front wall surface 36M of the fitting recess 36 and the rear drainage groove 37U extends straight along the rear wall surface 36U of the fitting recess 36. The front and rear drainage grooves 37M, 37U are substantially parallel and have equal widths in the front-back direction.

Figure 6:
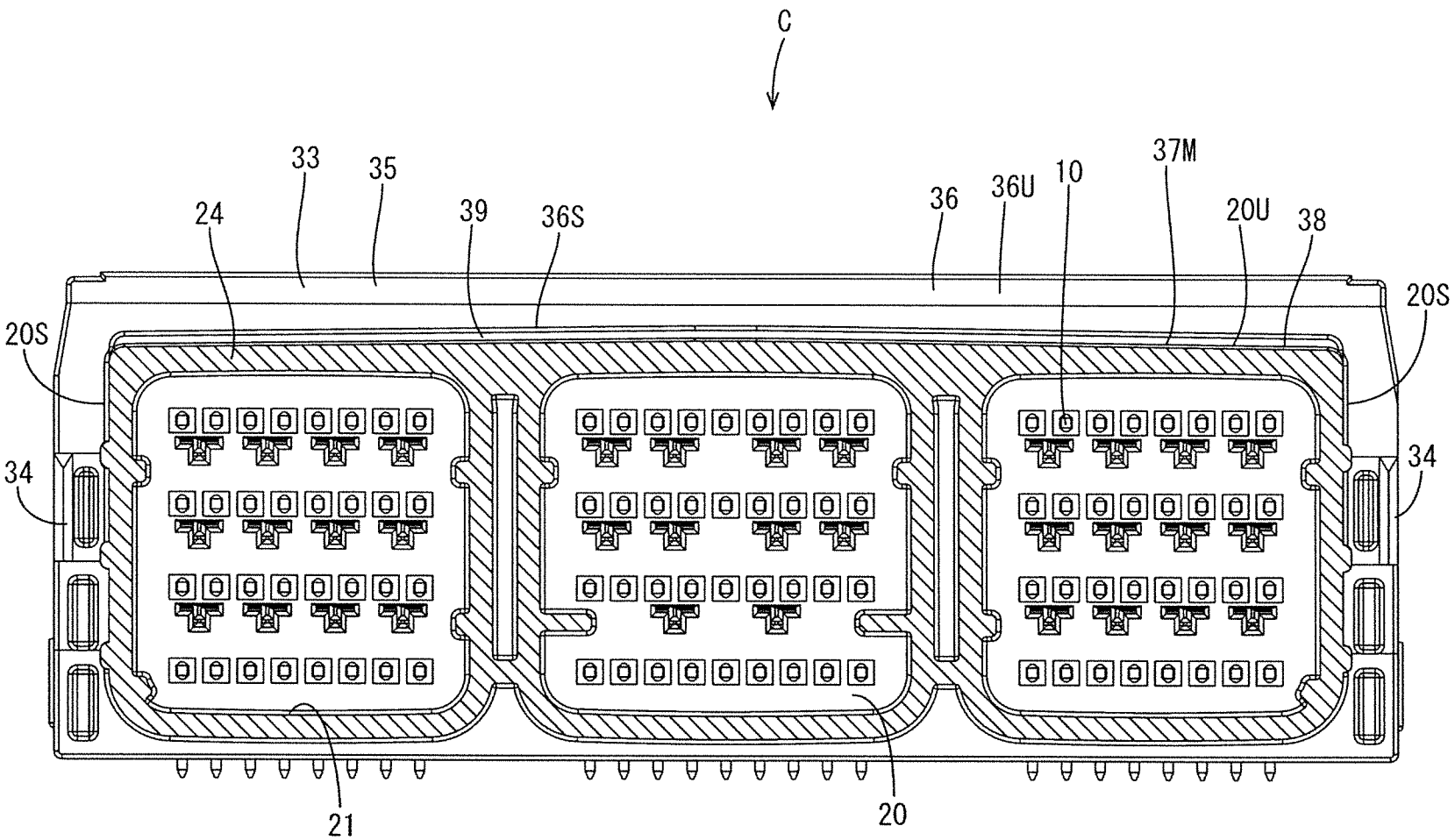
FIG. 6 is a section taken along line B-B of FIG. 4.

As shown in FIG. 6, bottom surfaces 38 of the front and rear drainage grooves 37M, 37U are inclined down from a center of the housing 20 in the width direction toward the opposite side surfaces 20S of the housing 20. Gradients of the bottom surfaces 38 of the front and rear drainage grooves 37M, 37U are equal on parts to the left and right of the center.

An elongated projection 39 is formed between the front and rear drainage grooves 37M, 37U. A width (dimension in the front-back direction) of the elongated projection 39 is slightly larger than a width of the rib 62. Note that the upper surface of the elongated projection 39 is an inclined surface substantially parallel to the bottom surfaces 38 of the front and rear drainage grooves 37M, 37U.

Figure 9:
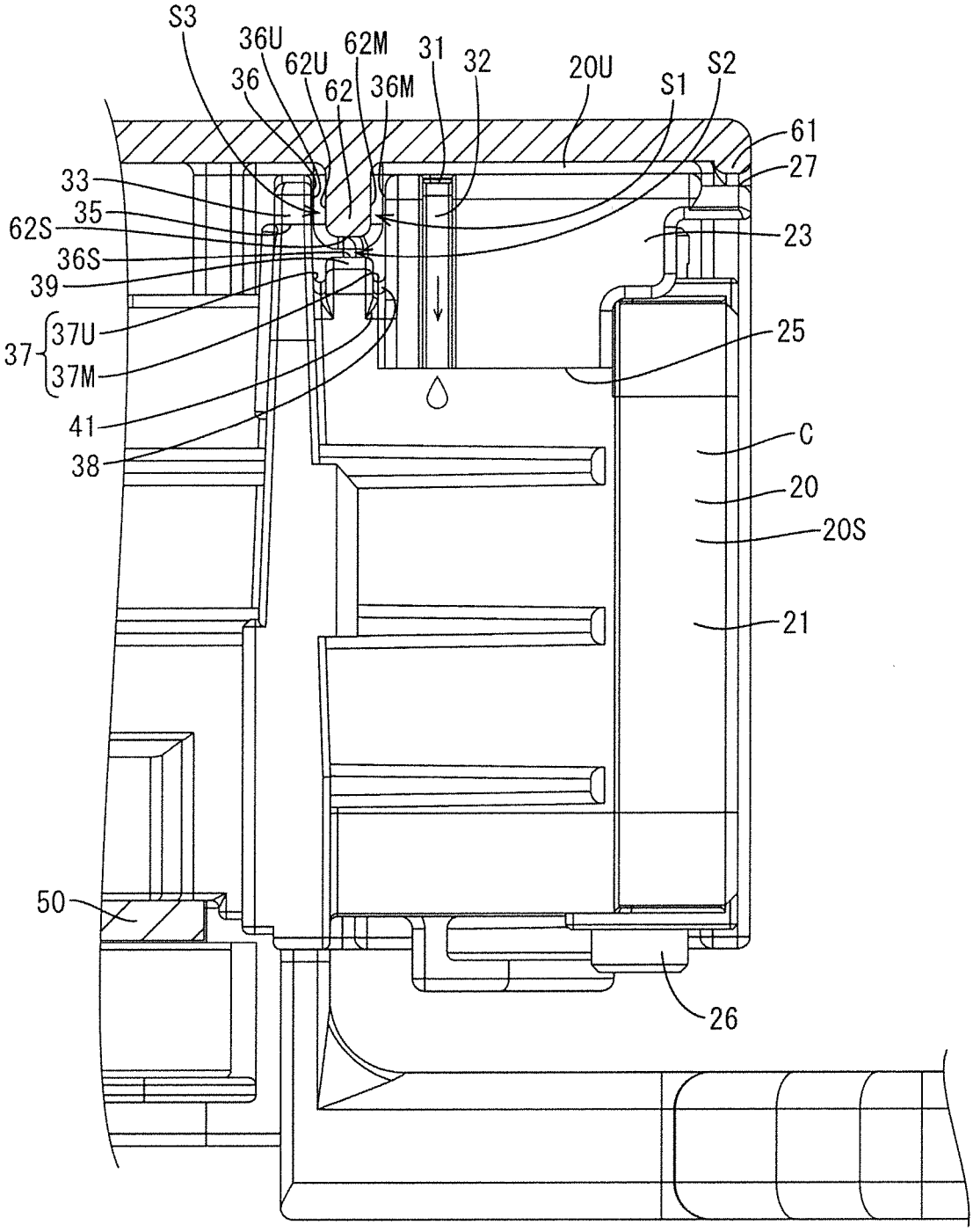
FIG. 9 is a partial enlarged section showing the state where the connector connected to the board is covered with the casing when a drainage groove is viewed laterally.

As shown in FIG. 9, widened portions 41 are provided on the opposite end parts of the front and rear drainage grooves 37M, 37U and are widened to have a larger groove width than other parts. The widened portions 41 are widened toward the back at the front drainage groove 37M and toward the front at the rear drainage groove 37U.

The front drainage groove 37M is narrower than the clearance S2 between the housing 20 and the casing 60 on a front side (side near the board 50) in a liquid entering direction. Further, the rear drainage groove 37U is narrower than the clearance S3 between the housing 20 and the casing 60 on the front side (side near the board 50) in the liquid entering direction. Note that the width of the front drainage groove 37M is smaller than the clearance S1 between the housing 20 and the casing 60 on a rear side (side opposite to the board 50) in the liquid entering direction and the width of the rear drainage groove 37U is smaller than the clearance S2 between the housing 20 and the casing 60 on the rear side in the same direction.

Any liquid that enter a clearance between the bulge 61 of the casing 60 and the recess 27 of the housing 20 and adheres to the upper surface 20U of the housing 20, the liquid first drops to the liquid retaining portion 31 and spreads along wall surfaces of the longitudinal grooves and the lateral grooves of the liquid retaining portion 31. The liquid spread in the liquid retaining portion 31 eventually reaches the side surface 20S of the housing 20 or the opening 29 and is discharged to the outside of the housing 20. The liquid having reached the side surface 20S of the housing 20 is discharged along the drain 32 formed on the side surface 20S of the housing 20, and the liquid having reached the opening 29 is discharged to the lever accommodating portion 23. The lever accommodating portion 23 and the connector fitting 21 are partitioned by the partition wall 24. Thus, the liquid that enters the lever accommodating portion 23 is discharged to the outside of the housing 20 without reaching the inside of the connector fitting 21.

Part of the liquid that enters the clearance between the casing 60 and the housing 20 may reach the rear of the liquid retaining portion 31. That liquid will drop in the clearance S1 between the housing 20 and the casing 60. Then, by capillary phenomenon, the liquid enters the front drainage groove 37M, which is narrower than the clearance S2 between the housing 20 and the casing 60 and the front drainage groove 37M located below the clearance S1 formed between the housing 20 and the casing 60. The liquid that enters the front drainage groove 37M is introduced smoothly to the side surface 20S of the housing 20 due to the inclination of the bottom surface 38 of the front drainage groove 37M and is discharged to the outside of the housing 20.

Part of the liquid that may have dropped in the clearance S1 between the housing 20 and the casing 60 may reach the clearance S2, and may proceed by capillary phenomenon to the rear drainage groove 37U, which is narrower than the clearance S3 formed between the housing 20 and the casing 60 and the rear drainage groove 37U located behind the clearance S2 formed between the housing 20 and the casing 60. The liquid that has entered the rear drainage groove 37U is introduced smoothly to the side surface 20S of the housing 20 due to the inclination of the bottom surface 38 of the rear drainage groove 37U and is discharged to the outside of the housing 20.

The waterproof portion 35 is behind the rear drainage groove 37U. Thus, the liquid is retained reliably before the waterproof portion 35 and is discharged to the outside of the housing 20 by the rear drainage groove 37U.

The connector C of this embodiment is configured so that the terminal fittings 10 extending from the housing 20 are connected to the board 50. The casing 60 for covering the board 50 is mounted on the side of the upper surface 20U of the housing 20. The front and rear drainage grooves 37M, 37U extend across the width of the upper surface 20U of the housing 20 and reach the opposite side surfaces 20S of the housing 20. Thus, liquid running along the upper surface 20U of the housing 20 enters the front or rear drainage groove 37M or 37U and is discharged to the side surface 20S of the housing 20. Accordingly, the liquid cannot enter into the side of the board 50 along the upper surface 20U of the housing 20.

The bottom surfaces 38 of the front and rear drainage grooves 37M, 37U are inclined down from the widthwise intermediate part of the housing 20 toward the opposite side surfaces 20S of the housing 20. Thus any liquid that enters the front or rear drainage groove 37M or 37U can be drained smoothly to the side surface 20S of the housing 20 due to the inclination of the bottom surface 38.

The front and rear drainage grooves 37M, 37U are narrower than the clearances S2 and S3 between the housing 20 and the casing 60 on sides closer to the board 50 than the front and rear drainage grooves 37M, 37U. Hence, the liquid enters more easily into the drainage grooves 37M, 37U than into the clearance S2 and S3 formed between the housing 20 and the casing 60 on the sides closer to the board 50 than the front and rear drainage grooves 37M, 37U. Thus, the entry of liquid into the side of the board 50 along the upper surface 20U of the housing 20 can be prevented more reliably.

Two drainage grooves 37 are spaced apart in the front-back directions. Thus, the liquid can enter the rear drainage groove 37U located on the rear side and can be drained even if the liquid reaches a side closer to the board 50 than the front drainage groove 37M. As a result, the entry of the liquid into the side of the board 50 along the upper surface 20U of the housing 20 can be prevented more reliably.

The invention is not limited to the above described embodiment, and the following embodiments also are included in the scope of the invention.

The bottom surfaces 38 of the front and rear drainage grooves 37M, 37U are inclined down from the widthwise center of the housing 20 toward the opposite side surfaces 20S of the housing 20. However, the bottom surfaces may be inclined down from a position closer to one end side than the widthwise center of the housing toward the opposite side surfaces of the housing.

The invention is applied to a connector C where the rib 62 of the casing 60 is fit into the fitting recess 36 of the housing 20 in the above embodiment. HHHHhhhHhhh HHhhh However, the invention can be applied also to a connector in which a housing has a flat upper surface with no fitting recess and no rib of a casing.

Two drainage grooves 37 are provided while being spaced apart in the front-back direction in the above embodiment. However, only one, or three or more drainage grooves may be provided.

LIST OF REFERENCE SIGNS

C . . . connector
S2 . . . clearance formed between housing and casing
S3 . . . clearance formed between housing and casing
10 . . . terminal fitting
20 . . . housing
20S . . . side surface of housing
20U . . . upper surface of housing
37 . . . drainage groove
37M . . . front drainage groove
37U . . . rear drainage groove
38 . . . bottom surface
50 . . . board
60 . . . casing

The invention claimed is:

1. A connector comprising:

a housing having opposite front and rear ends, opposite first and second side surfaces, an upper surface extending between the first and second side surfaces, and a recess formed in the upper surface and extending between the side surfaces;

terminal fittings extending from the rear surface of the housing for connection to a board;

a casing mounted on the upper surface of the housing for covering the board, the casing having a rib projecting into the recess; and front and rear drainage grooves provided in the recess on the upper surface of the housing and extending in the width direction of the housing, opposite ends of the drainage grooves reaching opposite side surfaces of the housing, a projection separating the front and rear drainage grooves, an upper surface of the projection being below the upper surface of the housing and opposed to the rib of the casing.

2. The connector of claim 1, wherein a bottom surface of each of the drainage grooves is inclined down from a widthwise intermediate part of the housing toward the opposite side surfaces of the housing.

3. The connector of claim 2, wherein a width of each of the drainage grooves is smaller than clearances between the rib of the casing and either of front and rear surfaces of the recess.

4. The connector of claim 3, wherein a distance between the rib of the casing and the projection between the front and rear grooves exceeds front to rear dimensions of the clearances between the rib of the casing and either of front and rear surfaces of the recess.

5. The connector of claim 3, wherein each of the front and rear grooves has an entrance defining an area of the respective groove closest to the upper surface of the housing and a base farthest from the upper surface of the housing, the grooves being narrower in a front to rear direction at the entrance than at the base.

6. The connector of claim 5, wherein the front groove is widened toward the rear at positions adjacent the base of the front groove, and wherein the rear groove is widened toward the front at positions adjacent the base of the rear groove.

7. The connector of claim 6, wherein an upper part of the projection is wider in the front to rear direction than a width of the rib of the casing in the front to rear direction.

8. The connector of claim 1, wherein the housing further comprises a continuous standing wall projecting from the first and second side surfaces and the upper surface in proximity to the rear surface.

* * * * *